US011724138B2

(12) United States Patent
Hong et al.

(10) Patent No.: US 11,724,138 B2
(45) Date of Patent: Aug. 15, 2023

(54) FLAME ARRESTERS

(71) Applicant: ELMAC TECHNOLOGIES LIMITED, Flintshire (GB)

(72) Inventors: Daomin Hong, Flintshire (GB); Lewis Bingham, Flintshire (GB); Peter Evans, Flintshire (GB)

(73) Assignee: Elmac Technologies Limited, Flintshire (GB)

( * ) Notice: Subject to any disclaimer, the term of this patent is extended or adjusted under 35 U.S.C. 154(b) by 287 days.

(21) Appl. No.: 16/175,342

(22) Filed: Oct. 30, 2018

(65) Prior Publication Data

US 2019/0060686 A1 Feb. 28, 2019

Related U.S. Application Data

(63) Continuation of application No. 15/115,053, filed as application No. PCT/GB2015/050202 on Jan. 28, 2015, now Pat. No. 10,143,869.

(30) Foreign Application Priority Data

Jan. 28, 2014 (GB) ..... 1401410
May 6, 2014 (GB) ..... 1407906

(51) Int. Cl.
*A62C 4/02* (2006.01)

(52) U.S. Cl.
CPC ..... *A62C 4/02* (2013.01)

(58) Field of Classification Search
CPC .... A62C 4/02; A62C 4/00; A62C 4/04; F42D 5/045; B01J 19/002
See application file for complete search history.

(56) References Cited

U.S. PATENT DOCUMENTS 1,701,805 A 2/1929 Dunn et al.
3,748,111 A 7/1973 Klose
(Continued)

FOREIGN PATENT DOCUMENTS

DE 934574 10/1955
DE 1020274 11/1957
(Continued)

OTHER PUBLICATIONS

PCT International Search Report, PCT/GB2015/050202 dated Aug. 4, 2015.
(Continued)

*Primary Examiner* — Jason Lau
(74) *Attorney, Agent, or Firm* — Curatolo Sidoti & Trillis Co., LPA; Salvatore A. Sidoti; Floyd Trillis, III

(57) ABSTRACT

A flame arrester (FA1) having an inlet (12) and an outlet (32), a housing (13, 23, 33) between the inlet (12) and outlet (32), one or more baffle plates (14, 34) and a flame arrester element (20) located within the housing (13, 23, 33). The inlet (12) has a maximum diametric dimension (D12). A first baffle plate (14) is located downstream of the inlet (12) and the flame arrester element (20) is located downstream of the first baffle plate (14). A second baffle plate (34) is located downstream of the flame arrester element (20) and upstream of the outlet (32). The baffle plates (14, 34) are secured to the inner wall of the housing (13, 23, 33) and each has an aperture (15, 35). The aperture (15) of the first baffle plate (14) has a minimum diametric dimension of at least 0.75D12.

15 Claims, 6 Drawing Sheets

(56) References Cited

U.S. PATENT DOCUMENTS

| | | | | |
|---|---|---|---|---|
| 4,909,730 | A | 3/1990 | Roussakis et al. | |
| 5,402,603 | A | 4/1995 | Henley | |
| 5,415,233 | A | 5/1995 | Roussakis et al. | |
| 5,905,227 | A | 5/1999 | Eichert et al. | |
| 6,342,082 | B1 | 1/2002 | Leinemann | |
| 6,409,779 | B2 * | 6/2002 | Leinemann | A62C 4/02 48/192 |
| 2001/0000837 | A1 | 5/2001 | Leinemann | |
| 2003/0022116 | A1 * | 1/2003 | Brooker | F23D 14/82 431/2 |
| 2006/0144599 | A1 | 7/2006 | Leinemann | |
| 2006/0260825 | A1 | 11/2006 | Cannel | |
| 2010/0218958 | A1 | 9/2010 | Cooling et al. | |

FOREIGN PATENT DOCUMENTS

| | | | | |
|---|---|---|---|---|
| DE | 1 023 408 | | 1/1958 | |
| DE | 29823686 | U1 * | 11/1999 | A62C 4/02 |
| GB | 407564 | | 3/1934 | |
| GB | 1586705 | | 3/1981 | |
| WO | 0137933 | | 5/2001 | |

OTHER PUBLICATIONS

PCT Written Opinion, PCT/GB2015/050202 dated Aug. 4, 2015.
PCT International Preliminary Report on Patentability, PCT/GB2015/050202 dated Aug. 2, 2016.
Great Britain Search Report, GB1407906.5 dated Nov. 3, 2014.
Great Britain Search Report, GB1401410.4 dated Nov. 4, 2014.
European Office Action, 15706266.2 dated Feb. 2, 2018.
Non Final Office Action U.S. Appl. No. 15/115,053 dated Apr. 9, 2018.

* cited by examiner

FLAME ARRESTERS

CROSS REFERENCE TO RELATED APPLICATIONS

The present application is a continuation of co-pending U.S. Ser. No. 15/115,053, filed Jul. 28, 2016, which is a national stage application of International Application No. PCT/GB2015/050202, filed Jan. 28, 2015, which claims priority from Great Britain Patent Application No. 1407906.5, filed May 6, 2014, and from Great Britain Patent Application No. 140410.4, filed Jan. 28, 2014.

This invention relates to flame arresters, and preferably, but not exclusively to detonation flame arresters.

Mixtures of a fuel and oxygen are capable of igniting. Indeed, mixtures of a fuel and oxygen are capable of exploding. When such mixtures explosively ignite, the flame front can propagate either through a process known as deflagration or a process known as detonation.

A flame front propagating by means of a deflagration travels through unburnt material, for example gas, at subsonic speeds. In contrast, a flame front propagating by means of a detonation travels through unburnt material, e.g. gas, at supersonic speeds, the shock wave associated with detonation and the flame front being coupled or superimposed. Clearly, due to the higher speeds and the greater destructive force it is more difficult to protect against detonation. However, it is essential to ensure that all unwanted combustion incidents are, so far as possible, avoided.

Whilst flame velocities in a deflagration are often in the range of 0.5 to 100 m $s^{-1}$ in an unconfined volume, the velocity can increase to several hundred metres per second within a conduit and may exhibit a 10-20 bar overpressure. By contrast, the combustion superimposed overpressure in a detonation may reach 10 to 100 times the initial pressure and flame velocities may reach several thousand metres per second.

When a combustible mixture is ignited by a low energy ignition source, such as a spark, the flame propagation will typically start as a deflagration. The deflagration is characterised by combustion occurring behind the pressure wave with the expansion of the combustion products driving the flame front forwards. However, as the flame accelerates the flame front can become unstable which causes turbulence. Turbulence leads to faster mass transport and increases the surface area of material, e.g. gas, to burn which, in turn, leads to rapid flame acceleration and the formation of shock waves ahead of the flame front. In certain circumstances, this can lead to the deflagration transitioning into a detonation.

It is usual for conduits through which ignitable materials, such as gases or mixtures of gases, are conveyed (or indeed conduits through which by-products or precursors of ignitable materials are conveyed), and/or containers containing such species, to be protected by flame arresters. Typically these slow down the flame front or otherwise interfere with propagation, so as to reduce the velocity of the flame front, disperse the energy therein and turn a detonation into a deflagration and/or to reduce the energy in a propagating deflagration so that the combustion can be controlled, contained and/or avoided.

It is essential that flame arresters, when installed in a conduit do not, so far as is possible, interfere with the normal operation of the conduit. For example, they should not cause a substantial impediment to gas flowing under usual operation conditions or otherwise cause a substantial pressure drop. A substantial flow impediment may well increase operating costs and may cause problems due to over compression of the conveyed material and/or the limit of the allowable overpressure of the conduit or vessel. Accordingly, it is usual for a flame arrester attached to a conduit to have a housing compartment which is of greater diameter than the conduit to which it is attached. The housing houses the flame arrester element which will span the housing. It is known for housings to have a diameter which is 1 to 4, and usually 1.0 or 1.5 to 3 times that of the pipe to which it is attached (i.e. for a circular conduit/flame arrester pair, a cross sectional area of 1 to 16, and typically 1:0 or 2.25 to 9, times that of the conduit to which it is attached).

Typically flame arresters protecting against deflagration have less substantial flame arrester elements than flame arresters protecting against detonation. In the most part this is due to the greater energy which must be dissipated in a detonation than in a deflagration. Accordingly, detonation flame arresters are typically more physically robust and usually contain a larger size flame arrester element (that is the flame arrester element may be thicker) or there may be a longer quenching length than a deflagration flame arrester to attenuate the shock wave as well as extinguish the flame. That said, detonation flame arresters will usually stop a deflagration.

Flame arresters have been known for a long time, the first being developed in 1815 by Sir Humphrey Davy to protect mineworkers against the risk of explosions caused by the naked flame in miners' helmets (the so-called "Davy Lamp"). Over the years many new flame arresters have been proposed. Examples of flame arresters can be found in U.S. Pat. Nos. 5,905,227, 6,409,779 and DE1023408.

In particular, U.S. Pat. No. 6,409,779 discloses several proposed flame arrester designs. The designs fall into two broad categories. The first utilises a single pipe stub of a diameter equal to that of the supply conduit. The pipe stub extends into the housing to ensure that expansion of the flame front can only occur at a position downstream of the nominal housing inlet. The second category includes a series of pipe stubs situated between the housing inlet and the flame arrester element which are intended to split an impinging detonation front into plural sub fronts, each directed onto a respective portion of the flame arrester element by one of the pipe stubs. In the first instance (e.g. FIG. 2) the distal end of the pipe stub is sufficiently close to the flame arrester element that a detonation front impinges directly on only a portion of the flame arrester element. In the second instance (e.g. FIGS. 7, 9) the distal end of the pipe stubs is sufficiently proximate the flame arrester element that the partial detonation fronts impinge directly on the facing portion of the flame arrester element. As will be appreciated, the force of the impinging wave front needs to be withstood by only a portion of the flame arrester element in either case.

There are certain combustible species which are used in a variety of chemical and industrial processes. One of the most widely used industrial chemicals is ethylene oxide (EO), Which has the chemical formula $C_2H_4O$ and is highly reactive. EO is flammable in air from concentrations of 2.6 to 100% and ignition of the thermal decomposition reaction can occur at 500° C. This chemistry makes the challenge of preventing EO deflagrations and detonations very onerous. Indeed, it is well known for EO flames to transition to detonations when travelling through ductwork or conduits. Other gaseous species which require detonation protection are hydrogen and ethylene. As is well known, there are many others.

Whilst flame arresters in general have been known for about two hundred years there is still a need for a flame arrester which is robust and has at least some generally applicable features.

Indeed, it is an object of this invention to provide a new flame arrester which is easy to install, robust and effective and/or which has improved performance over prior art flame arresters.

More particularly, it is an object of this invention to provide a flame arrester which demonstrates one or more of:

a) an improved flame arrester performance without increasing flame arrester element diameter;
b) an increased operating pressure without corresponding increase of the flame quenching length;
c) a reduced shock wave impact on the flame arrester element;
d) an at least reduced reflected shock wave effect on the flame arrester element; and
e) an at least reduced reflected shock wave effect from the housing.

Accordingly, a first aspect of the invention provides a flame arrester, the flame arrester comprising an inlet and an outlet, a housing between the inlet and outlet and a baffle plate and a flame arrester element located within the housing, wherein the inlet for gas to enter the housing has a maximum diametric dimension D, the baffle plate is located downstream of the inlet and the flame arrester element is located downstream of the baffle plate, the baffle plate is secured to the inner wall of the housing and has an aperture which has a minimum diametric dimension of at least 0.75D.

In some embodiments the minimum diametric dimension of the aperture is 0.8D or more, preferably ≥0.85D, ≥0.9D, ≥0.95D, ≥1.0D, or ≥1.05D and most preferably ≥1.1D. In some embodiments the minimum diametric dimension of the aperture is up to 1.5D, for example up to 1.6D, e.g. up to 1.8D and may be as high as 2D. The minimum diametric dimension is thus typically from 0.75D to 2D or from 0.75D to 1.8D, for example from 0.75D to 1.6D, and preferably from 0.8D to 1.55D, most preferably from ≥0.85D, ≥0.9D, ≥0.95D, ≥1.0D, ≥1.05D or ≥1.1D to ≤1.5D, say 1.45D, 1.4D, 1.35D, 1.3D, 1.25D, 1.2D or 1.15D.

The distance between the leading face or portion of the baffle plate and the leading face of the flame arrester element may be between 0.1 to 2.5 times the minimum diametric dimension of the aperture, and is preferably 0.2 to 2.0, preferably 0.3 to 1.5, more preferably 0.4 to 1.0, for example, 0.5 or 0.75 times the minimum diametric dimension of the aperture. The distance between the leading face or portion of the baffle plate and the trailing edge of the inlet may be varied or variable.

The baffle plate is typically secured to the internal wall of the housing. The dam height of the baffle plate (i.e. the distance of the aperture of the baffle plate from the periphery of the baffle plate) is preferably 0.05 to 1.625D, for example 0.125 to 1.625D, and more preferably 0.1 to 1.5D, for example 0.15 to 1.5D, and most preferably from 0.15 to 1.45D. In an embodiment where the housing has a diameter of up to 3D, the dam height of the baffle plate may be from 0.05 to 1.125D. The dam height of the baffle plate may be from 0.1 to 0.75D. In some or many embodiments a dam height of 0.2D may be chosen.

Typically the minimum diametric dimension of the housing $D_H$, as measured immediately upstream of the aperture, may be from 1 to 4D, and is usually 1 or 1.5D to 3D. The aperture may have a minimum diametric dimension of from 0.19 to $0.8D_H$, say 0.2 to $0.8D_H$, and most preferably from 0.37 to $0.75D_H$.

The aperture preferably defines a plane, the plane may be parallel to a leading face of the flame arrester element. In other embodiments the plane may be inclined to the leading face of the flame arrester element.

The centre of the aperture (i.e. a diametric straight line mid-point between the walls defining the periphery of the aperture, or an average of plural of the same), or the plane defined by the aperture may be located or spaced a distance from the leading face of the flame arrester element of 0.1D to 2.0D, say 0.2D to 1.5D, preferably 0.3D to 1.0D, and in certain embodiments from 0.4D to 0.75D for example 0.5D.

We have surprisingly found that, to achieve at least one of the objectives of the invention, it is preferable to design a flame arrester with a certain ratio of cross sectional surface area of inlet (or supply conduit) to baffle aperture or total flow through area of the baffle plate. In some embodiments the ratio is from 0.5 to 4.0, for example 0.55 or 0.56 to 4.0. In a preferred embodiment the ratio is from 0.5 to 2.5, for example 0.55 to 2.5, preferably from 0.55 to 2.0 and more preferably from 0.75 to 1.75.

The baffle plate is preferably flat and featureless, at least on its leading face. The baffle plate may have a leading face which lies in a plane parallel or inclined to the or a leading face of the flame arrester element. Alternatively, the baffle plate may have a leading aperture and may taper or flare (regularly or irregularly) outwardly away from the aperture in the flow direction. Alternatively, the baffle plate may taper of flare (regularly or irregularly) inwardly in the flow direction to a trailing aperture. In some embodiments the baffle plate may define a frusto-cone.

The flame arrester may comprise a secondary baffle plate, downstream of the abovementioned, first baffle plate but upstream of the flame arrester element. The secondary baffle plate may comprise an aperture. The aperture in the secondary baffle plate may be larger, smaller or the same size as the aperture of the first baffle plate. The aperture in the secondary baffle plate may be aligned with, i.e. concentric to, the aperture of the first baffle plate. Alternatively, the respective apertures may be at least partially misaligned and may be totally misaligned in the flow direction, thereby to provide an, at least partially, tortuous flow path.

The flame arrester may comprise a flow diverter, for example a diverter plate or deflector plate, which may be located upstream, in line with at least a portion of the aperture of, or downstream of the baffle plate and downstream, in line with at least a portion of the aperture of, or upstream of the secondary baffle plate, if present.

Preferably the flame arrester has an axis of rotational symmetry, which may define the centre of a principal flow path for, for example, gas passing there through. Preferably, the baffle plate and flame arrester element are symmetrically located about the axis of rotational symmetry. Preferably the aperture of the baffle plate is symmetrical about the axis of symmetry.

The aperture of the baffle plate may comprise a primary or main aperture thereof. The aperture of the secondary baffle plate may comprise a primary or main aperture thereof. The baffle plate and/or secondary baffle plate may comprise one or more further apertures, e.g. satellite apertures. Any such further apertures may be regularly or irregularly distributed about the baffle plate and/or secondary baffle plate. Preferably any such further aperture or apertures may be provided toward the external periphery of the respective baffle or secondary baffle plate. Any such further aperture or apertures will preferably comprise a minor proportion of the surface area of the respective baffle or secondary baffle plate.

The flow diverter may be provided with apertures. Preferably, the area defined by any such apertures will comprise a minor proportion of the surface area of the flow diverter.

In preferred embodiments the total flow through area (TFTA) of the baffle plate is less than 2.5 times the area of the inlet, and preferably from 0.55 or 0.56 to 2.5 times the area of the inlet conduit.

A second aspect of the invention comprises a flame arrester, the flame arrester comprising an inlet having a cross sectional area $A_i$ and an outlet with a housing therebetween, the housing containing a flame arrester element, between the inlet and the flame arrester element is a baffle plate to separate the housing into separate zones, the baffle plate has one or more apertures therein with a total cross sectional area $A_b$, and wherein $A_b$ is from 0.55 to 2.5 times $A_i$.

The baffle plate may separate the housing into upstream and downstream compartments, and will typically attenuate direct shock waves and/or reflected shocks, e.g. both primary reflections and secondary reflections. The baffle plate may restrict the supersonic flow, including hot combustion products, from the upstream to the downstream compartments, e.g. dependent on the cross sectional area $A_b$ (and/or diameter d) of the aperture(s) in said baffle plate.

A third aspect of the invention provides a flame arrester comprising an inlet and outlet and a housing therebetween, a flame arrester element being housed within the housing, therein the flame arrester element has a solid centre portion to prevent fluid flow therethrough and a peripheral portion to permit fluid flow, wherein the inlet has a maximum diametric dimension D and the solid centre portion has a diametric dimension of from 0.75D to 1.25 or 2.5D, preferably from 0.8D to 1 or 1.5D.

A fourth aspect of the invention provides a method of fabricating a flame arrester element, the method comprising providing a, preferably solid, mandrel of maximum diametric dimension T and winding a crimped ribbon around the mandrel until the so-formed flame arrester element has a diametric dimension A and wherein A is from 4T/3 to 16T/3, preferably 4T/3 to 4T, and most preferably 1.5T to 4T.

A further aspect of the invention provides a flame arrester, the flame arrester comprising an inlet and an outlet, a housing between the inlet and outlet and a baffle plate and a flame arrester element located within the housing, wherein the baffle plate comprises an aperture and wherein at least a portion of the baffle plate flares inwardly or outwardly in the flow direction to or from the aperture.

In a preferred embodiment, the baffle plate is attached to the inner wall of the housing. Additionally or alternatively, the baffle plate may be upstream of the flame arrester element.

In one embodiment, the baffle plate is frusto-conical. Preferably, the baffle plate flares outwardly in the flow direction.

A further aspect of the invention provides a flame arrester comprising:

a housing having a cavity;

a flame arresting element;

a plate member extending across said cavity within the housing, said plate member positioned between a first end and a second end of the housing;

wherein a radially outermost part of said plate member is attached to part of an inner wall of said housing which is at least as radially distant from a main central axis of said housing as said radially outermost part of said plate member;

said plate member dividing said cavity into a first chamber and a second chamber;

said plate member having at least one aperture;

said at least one aperture extending through said plate member in a direction transverse to a main surface of said plate member;

characterised by there being no guide members extending from said plate member to direct a pressure wave onto said flame arresting element;

wherein the plate member blocks a portion of an incident pressure wave in the first chamber and a portion of any reflected pressure wave within the first chamber from passing into the second chamber;

said plate member restricts the flow of hot gases into the second chamber;

said at least one aperture rarefies said pressure waves by means of expansion of said pressure waves into the second chamber; and said pressure wave passes from said first chamber to said second chamber only via said at least one aperture through said plate member.

The flame arresters of the invention are preferably detonation flame arresters.

It has surprisingly been found that flame arresters of the invention are able to operate at higher pressures and/or are able to withstand greater and/or more powerful detonations than those of the prior art.

In order that the invention may be more fully understood, it will now be described, by way of example only, and with reference to the accompanying drawings, in which.

Figure 1:
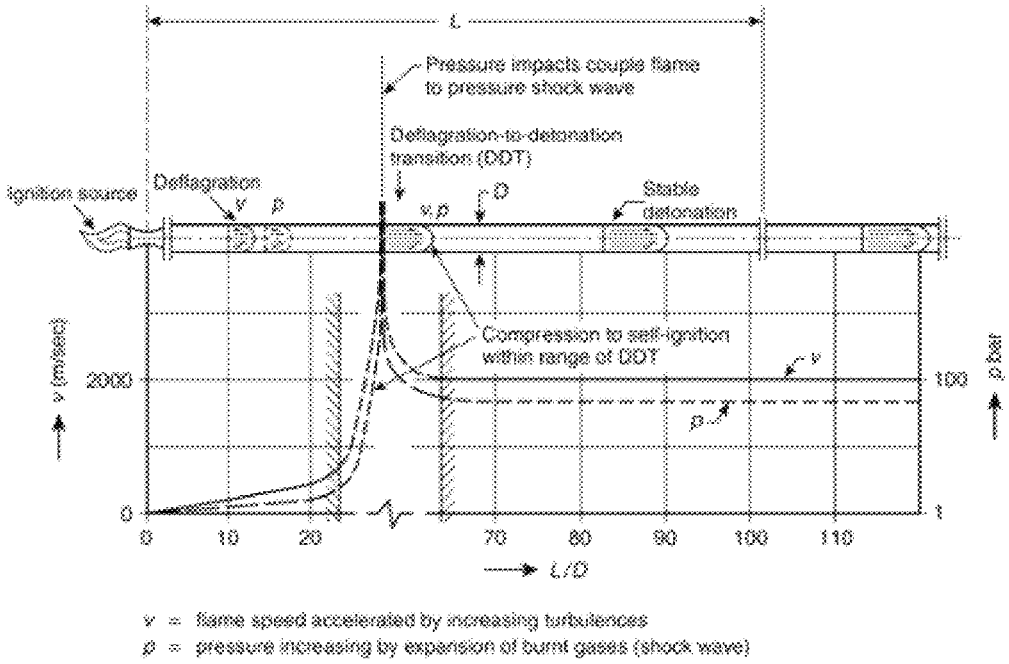
FIG. 1 is a generalised schematic diagram of a propagating flame front in a confined pipeline.

Referring first to FIG. 1, there is shown a flame velocity and pressure curve of a confined explosion process. In this case, it shows a velocity and pressure curve of combustion occurring in a pipe and propagating from the ignition source along the pipe, first as a deflagration and subsequently as a detonation after passing through a deflagration-to-detonation transition (DDT). This diagram is taken from NFPA 69:2008 Standard on Explosion Prevention Systems.

As can be seen, the deflagration is characterised by subsonic velocities and low pressures, whereas the detonation is characterised by high, supersonic, velocities and high pressures. The DDT usually occurs at a ratio L:D of greater than 50 for hydrocarbon-air mixtures and greater than 30 for hydrogen-air mixtures, where L is the length of the pipe from the ignition source (typically called the run-up distance) and D is the inner diameter of the pipe. The DDT is characterised by a rapid and sharp escalation in velocity and pressure. Once the flame and pressure waves are coupled, the velocity and pressure drop and propagation continues as a stable detonation with auto-ignition of the gas or gas mixture caused by adiabatic compression of the gas mixture by the shock wave.

Figure 2A:
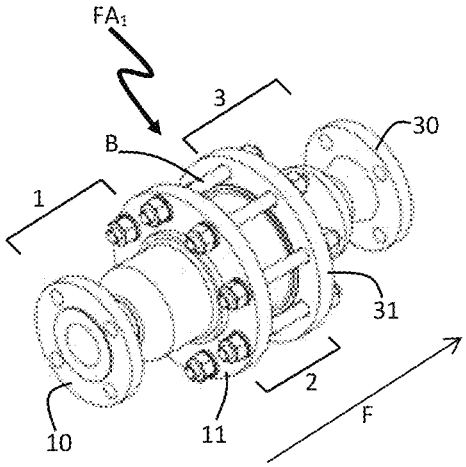
FIG. 2A shows a first embodiment of a flame arrester according to the invention.
Figure 2B:
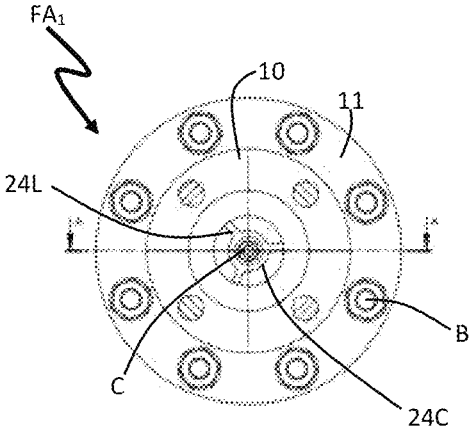
FIG. 2B is an end elevation of the flame arrester of FIG. 2A.

Referring now to FIGS. 2A-D, and specifically to FIGS. 2A and 2B in the first instance, there is shown a flame arrester $FA_1$ according to the invention comprising, in the direction of intended flow (as indicated by arrow F) an entrance portion 1, a central portion 2 and an exit portion 3. The entrance portion 1 comprises a flange 10 for attachment to a supply conduit (not shown) and the exit portion 3 comprises a flange 30 for attachment to an exhaust conduit (not shown).

The entrance portion 1 and exit portion 3 are respectively attached to the leading and trailing ends of the central portion 2 by means of respective connection flanges 11, 31 and a series of interconnecting bolts B to secure the three portions 1-3 together. Of course, other attachment means can be used to secure the three portions 1-3.

The three portions 1-3 together define a flow path C along the flame arrester $FA_1$ for the passage of gases. As shown, the flow path C has a principal axis which is parallel to and aligned with an axis of rotational symmetry of the flame arrester $FA_1$. In this specification we call that a concentric flame arrester. It is also possible to have an off-axis flame arrester and this disclosure applies equally to such arrangements.

Figure 2C:
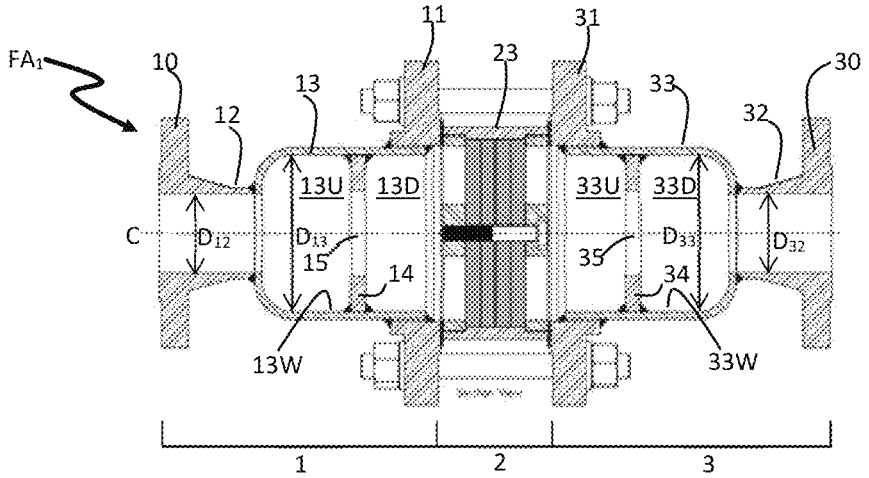
FIG. 2C is a sectional view along line A-A of FIG. 2B.
Figure 2D:
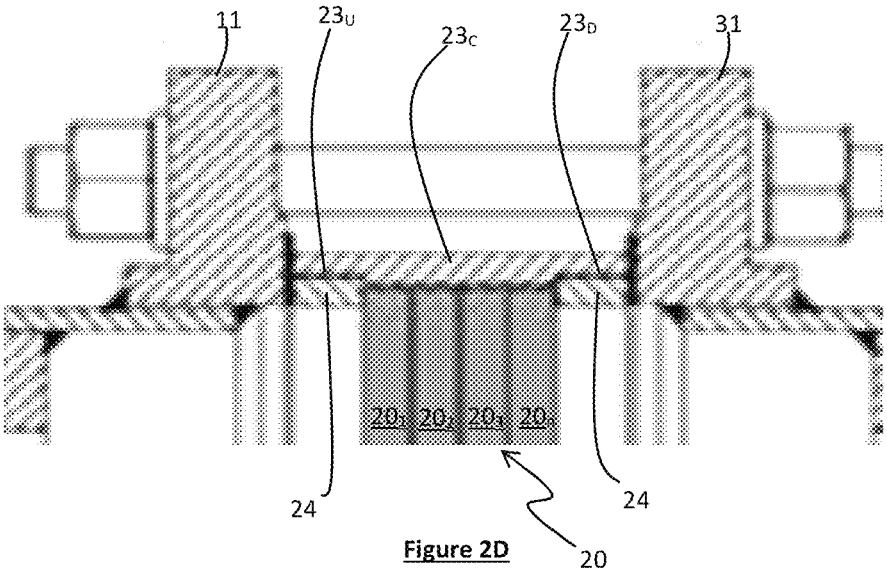
FIG. 2D is an enlarged view of a portion of FIG. 2C.

Referring now to FIGS. 2C and 2D, the internal construction of the flame arrester $FA_1$ can be seen.

The entrance portion 1 comprises a lead-in conduit 12, which has an internal diameter $D_{12}$ that is typically the same as that of the supply conduit (not shown), and a tubular housing portion 13 with an internal diameter $D_{13}$ which is larger than the internal diameter $D_{12}$. The housing portion 13 is subdivided into upstream 13U and downstream 13D portions by a baffle plate 14 which is secured to and extends from the internal wall 13W of the housing portion 13. The baffle plate 14 has a central aperture 15 which is aligned with (and is preferably concentric with) the principal axis of the flow path C. In this and other embodiments, the housing, baffle and flame arrester element are concentric with an axis of rotational symmetry which is aligned with the principal axis of the flow path C.

The exit portion 3 comprises a lead out conduit 32, Which has an internal diameter $D_{32}$ which typically is the same as that of the exhaust conduit (not shown), and a tubular housing portion 33 with an internal diameter $D_{33}$ which is larger than the internal diameter $D_{32}$. The housing portion 33 is subdivided into upstream 33U and downstream 33D portions by a baffle plate 34 which is secured to and extends from the internal wall 33W of the housing portion 33. The baffle plate 34 has a central aperture 35 which is aligned with (in this embodiment, and at least some other embodiments; concentric with) the principal axis of the flow path C.

As will be appreciated $D_{13}$ need not be equal to $D_{33}$, it may be larger or smaller. Additionally or alternatively $D_{12}$ need not be equal to $D_{32}$, it may be larger or smaller. For ease of manufacture the diameter of the housing portions 13, 33 is the same in respective upstream 13U, 33U and downstream 13D, 33D portions, although it may be different in either or both cases.

The central portion 2 comprises an annular housing 23 which retains a flame arrester element 20 which may be fabricated by any means known in the art for example a knitted metal mesh, a coiled crimped metal ribbon or a sintered metal mesh structure. For performance reasons, we prefer to use a coiled, crimped e.g. metal ribbon although the specification is not so-limited. The flame arrester element 20 can be provided by a stack of sub elements $\mathbf{20}_1$, $\mathbf{20}_2$ . . . $\mathbf{20}_n$ which can be altered in number according to the performance requirements of the flame arrester $FA_1$. If plural flame arrester sub elements $\mathbf{20}_n$ are used, the stack may be held together by a centrally disposed bolt or other attachment means.

As shown, the flame arrester element 20 spans the entire diameter of this central portion 2.

The annular housing 23 has a centre portion $\mathbf{23}_C$ which is bounded, both upstream and downstream, by rebated peripheral portions $\mathbf{23}_U$ and $\mathbf{23}_D$ respectively. The flame arrester element 20 extends from one side of the housing 23 to the other and is aligned with and held in place on the centre portion $\mathbf{23}_C$ by abutment rings 24, one of each being located in respective rebated portions $\mathbf{23}_U$ and $\mathbf{23}_D$. The abutment rings 24 contact a respective upstream or down stream peripheral edge of the flame arrester element 20 and a facing surface of the flanges 11, 31 so as to ensure that the flame arrester element 20 is prohibited from moving during use.

Alternatively, the centre portion $\mathbf{23}_c$ need not be bounded by rebated peripheral portions, one or both abutment rings 24 may rest on apportion of the annular housing which is aligned with the centre portion $\mathbf{23}_c$, the or each of the abutment rings 24 being held in place by other means.

Figure 2E:
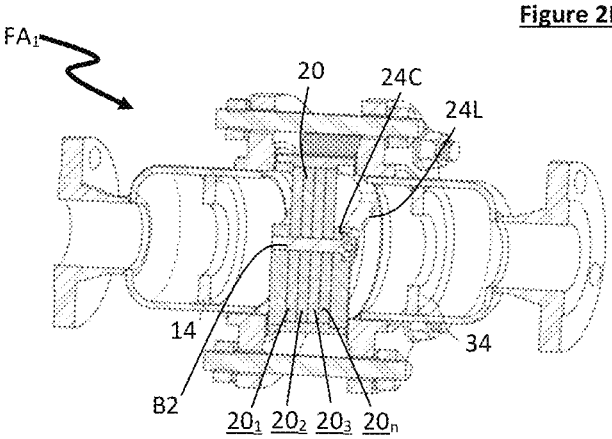
FIG. 2E is an isometric sectional view of the flame arrester of FIG. 2A.
Figure 2F:
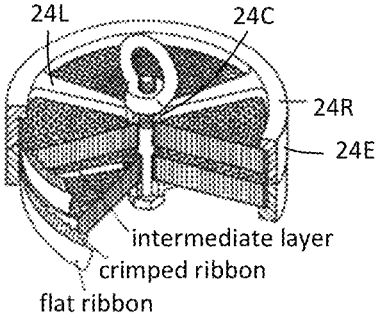
FIG. 2F is a cutaway view of a flame arrester element.

Referring to FIGS. 2E 2F, there is shown an isometric cutaway view of the internal construction of the flame arrester $FA_1$ in which one embodiment of a flame arrester element 20 may be more clearly seen. The stack of sub elements $\mathbf{20}_1$, $\mathbf{20}_2$ . . . $\mathbf{20}_n$ of the flame arrester element 20 may be held relative to each other by a bolt B2 and contained by an enclosing structure or cage 24E having a peripheral rim 24R, a central hub 24C and plural limbs or spokes 24L connecting the central hub 24C to the peripheral rim 24R. Although three plural limbs 24L are indicated by FIG. 2E there may, for example, be four such plural limbs 24L, or any number as may be determined by the required flow-through characteristics of the flame arrester element 20 and/or by required explosion characteristics (for example, explosion peak pressure).

Whilst FIG. 2F shows a cutaway view of a flame arrester element 20 utilizing crimped ribbon, other flame arrester element constructions may be used. The flame arrester element 20 is usable within the (or any) flame arrester of the invention described herein. Clearly the central hub 24C provides a solid face on which gases will impinge. Although a lifting eye (not labelled) is shown in FIG. 2F it will be appreciated by those skilled in the art that other nuts may be/are more preferably used.

Figure 3:
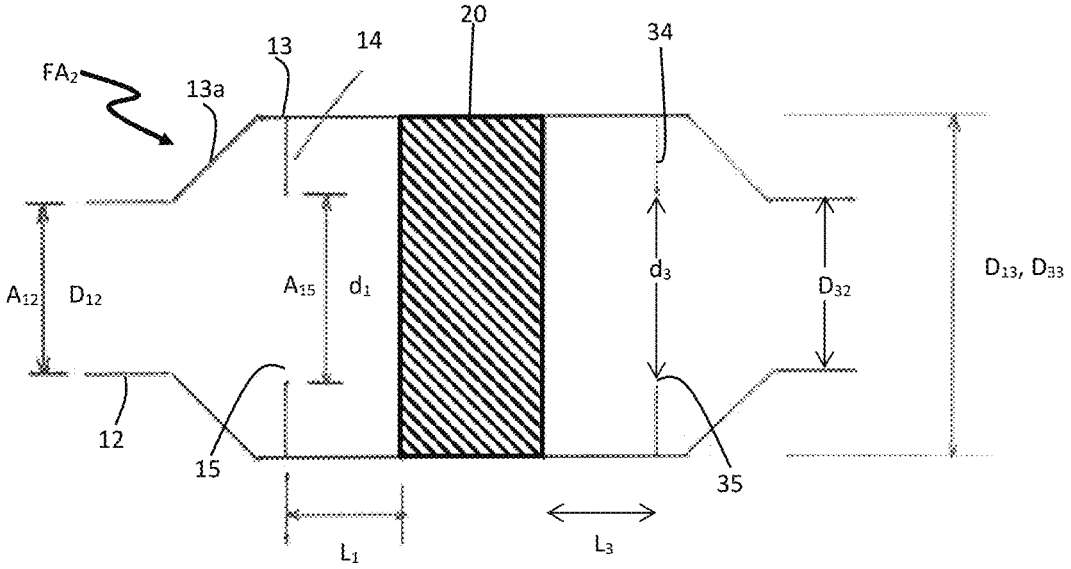
FIG. 3 is a generalised schematic representation of the flame arrester of FIG. 2A.

Turning now to FIG. 3, there is shown a flame arrester according to the invention $FA_2$, which is a generalised version of the flame arrester $FA_1$. In this flame arrester $FA_2$, $D_{13}$ is equal to $D_{33}$ and $D_{12}$ is equal to $D_{32}$.

Figure 3A:
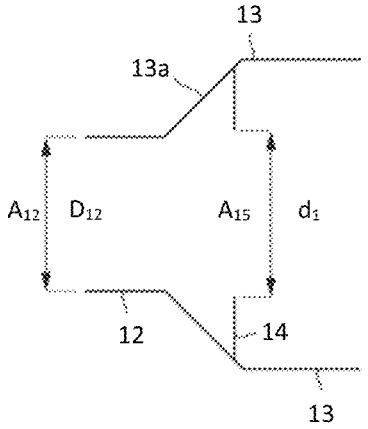
FIG. 3A shows a partial sectional view of an alternate embodiment of the flame arrester of FIG. 2A.

The entrance portion 1 comprises a lead-in conduit 12, a housing 13 and an annular wall member 13*a* to join the two. The entrance portion houses a baffle plate 14 which has a central aperture 15 with a diameter $d_1$ and is positioned a distance $L_1$ from the leading face of the flame arrester element 20. The exit portion 3 comprises a baffle plate 34 which has a central aperture 35 with a diameter $d_3$ and is positioned a distance $L_3$ from the trailing face of the flame arrester element 20. As shown $d_1$ is equal to $d_3$ but it need not be, it may be larger or smaller. The baffle plate 14, 34 is shown in FIG. 3 as being secured to and extending from housing 13. Alternatively, the base plate 14, 34 may be secured to and extend from e.g. the frusto conical lead in and/or lead out portions, for example the annular wall member 13*a*, which may enable the overall length of the housing 13 (and hence the flame arrester $FA_2$) to be relatively shorter. An example in relation to the lead in portion is shown in FIG. 3A In some embodiments $d_1 \geq 0.75D_{12}$, but in a preferred embodiment $d_1 \geq 0.8D_{12}$, preferably $d_1 \geq 0.85D_{12}$, $d_1 \geq 0.9D_{12}$, $d_1 \geq 0.95D_{12}$, $d_1 \geq 1.0D_{12}$, or $d_1 \geq 1.05D_{12}$ and most preferably $d_1 \geq 1.1D_{12}$ and in each case is less than $1.6D_{12}$ or could be less than $2D_{12}$. In a preferred embodiment, the ratio of surface area of baffle aperture $A_{15}$ to surface area of supply conduit $A_{12}$ (i.e. $A_{15}$:$A_{12}$) is from 0.55 or 0.56 to 4.0, for example from 0.55 or 0.56 to 2.0 or 2.5 and preferably from 0.64 to 1.21.

In a further preferred embodiment for a flame arrester $D_{13} \geq 1.5D_{12}$, preferably $D_{13} \geq 1.6D_{12}$, $D_{13} \geq 1.7D_{12}$, $D_{13} \geq 1.8D_{12}$, $D_{13} \geq 1.97D_{12}$, $D_{13} \geq 2.0D_{12}$, $D_{13} \geq 2.5D_{12}$, $D_{13} \geq 3.0D_{12}$, and most preferably $D_{13} > 2.0D_{12}$.

In some embodiments $L_1$ is from $0.1D_{12}$ to $2.0D_{12}$, say $0.2D_{12}$ to $1.5D_{12}$, preferably $0.3D_{12}$ to $1.0D_{12}$, and in certain embodiments from $0.4D_{12}$ to $0.75D_{12}$, for example $0.5D_{12}$ or larger.

In some embodiments $L_3$ is from $0.1D_{32}$ to $2.0D_{32}$, say $0.2D_{32}$ to $1.5D_{32}$, preferably $0.3D_{32}$ to $1.0D_{32}$, and in certain embodiments from $0.4D_{32}$ to $0.75D_{32}$, for example $0.5D_{32}$ or larger.

In normal operation, the flame arrester $FA_2$ will be installed into a supply conduit for an explosive or flammable gas. Due to a line-of-sight path between the entrance 1 and exit 3 portions, through the apertures 15, 35 or the respective baffle plates 14, 34 and the flame arrester element 20, there is no significant additional pressure drop caused by the presence of the baffle plate 14 and baffle plate 34.

In the event of the gas igniting and flame propagating, for example as a detonation, a flame front and shock wave will propagate along the conduit until it enters the lead-in conduit 12 of the entrance portion 1 of the flame arrester $FA_2$. Upon leaving the lead-in conduit 12 the shock wave will pass into the housing 13. Because the housing 13 has a greater cross sectional area than the lead-in conduit 12 (i.e. $D_{13}$ is greater than $D_{12}$) the shock wave will expand as it enters the housing 13. In terms of the compression shock wave, the shock wave is rarefied as it enters the housing 13. At least a portion of the shock wave will continue to propagate along the entrance portion 1, through the housing 13, along the flow path C and through the aperture 15 in the baffle plate 14.

Accordingly, a portion of the flame front and shock wave will be attenuated by the baffle plate 14. The relatively large size of the aperture 15 allows at least a portion of the flame front and pressure wave to pass through relatively unimpeded. However, passing through the aperture 15 will likely cause secondary expansion of at least a part of the propagating wave front. Indeed, the distance $L_1$ is chosen to allow at least some expansion of the propagating wave front. The subsequently expanded propagating shock wave and flame front will thus collide with the flame arrester element 20. Most of the propelled material will pass through the flame arrester element 20, which will act to remove further energy from the wave front and thereby attenuate the detonation into a deflagration and then flame is quenched and continuation of the combustion processes is prevented (or in the case of deflagration only propagation, flame and combustion products are cooled down by the flame arrester element).

Although we do not wish to be bound by any theory, we believe that the presence of the baffle plate 14, together with the relatively large aperture 15 has two direct effects to improve the performance of the flame arrester $FA_2$.

Firstly, the relatively large aperture 15 ensures that during 'normal use' there is no substantial pressure drop across the baffle plate 14, which is to say that the pressure difference between the upstream 13U and downstream 13D portions of the housing 13 is minimised. This ensures that during normal use of the conduit, the baffle plate 14 does not unnecessarily inhibit the passage of gas flow, which is beneficial to operation of the conduit line. Moreover, in the event of an explosion event, whilst the baffle plate 14 is able to attenuate a portion of the onrushing pressure wave, the aperture 15 of the baffle plate 14 substantially restricts the combustion products of very high temperature into downstream 13D compartment of the housing 13.

Secondly, it is possible for the shock wave entering the upstream portion of the housing 13U to reflect from the wall of the housing, e.g., from annular wall element 13*a*. The baffle plate 14 further acts to reduce the likelihood of propagation of those shock waves as well. Moreover, the baffle plate is large enough (i.e. the size of the aperture is controlled) such that although the or a portion of the initial propagating wave front will reflect from the baffle plate, any wave reflected back at the baffle plate after colliding with the housing (e.g. tubular wall portion 13*a*) will be attenuated by the baffle plate 14.

Because the shock waves (both initial and reflected) are weakened by the construction mentioned above, it is possible to engineer the flame arrester element 20 such that its physical characteristics are optimised for use (rather than simply being over-engineered). Moreover, the particular physical requirements of the housing can be engineered to optimal levels. Both of these ramifications can lead to size, weight and/or cost savings.

The downstream baffle plate 34 of the exit portion 3 is to make the flame arrester bi-directional. It is convenient for installation that flame arresters of the invention can operate in either direction, i.e., flame can come in either direction, which is to say the flame arresters are usually the same in forward and reverse flow directions. This mitigates against installers installing the flame arrester the wrong way around. Additionally, bi-directional flame arresters are required in certain applications (i.e. where it is possible that flame can come in either direction). Of course, and as stated above, it is not necessary in this invention that there is identicality in the nature and position of the components. We also believe, although we do not wish to be bound by any such theory, that there may be positive ramifications in terms of flow through the flame arrester in 'normal' use and/or during a deflagration/detonation event.

We have recognised that providing a substantially flat baffle plate 14 (which may have optional short control extensions of the downstream face) and by controlling the distance the leading face of the baffle plate 14 is from the leading face of the flame arrester element 20 (actually the distance a plane formed by the aperture 15 is from the leading face of the flame arrester element 20) a highly versatile flame arrester can be provided which is highly effective in arresting explosions.

In order to test the efficacy of the above flame arrester $FA_2$ a series of experiments were conducted, as follows:

Experiment 1 (Control)

A flame arrester was constructed with $D_{13}$ equal to $2D_{12}$ but absent the baffle plate 14. The flame arrester worked for a maximum test pressure of 1.54 bar. The flame arrester failed at 1.57 bar.

Experiment 2

A flame arrester $FA_2$ according to the invention was constructed, identical to that used in Experiment 1 but with the addition of a baffle plate 14. The flame arrester $FA_2$ had the following characteristics:

| Feature | Dimension |
|---|---|
| Lead-in Conduit 12 | $D_{12}$ |
| Housing $D_{13}$ | $2D_{12}$ |
| Aperture 15 | $d_1 = 1.1D_{12}$<br>$d_1 = 0.55D_{13}$ |
| Baffle dam height | $0.45D_{12}$<br>$0.225D_{13}$ |
| $A_{15}/A_{12}$ | 1.21 |
| $L_1$ | $D_{12}/2$ |

The flame arrester continued to work at 1.92 bar, thereby showing a significant improvement over the flame arrester absent the baffle plate 14.

It has been established that there is a close relationship between the maximum operating pressure that a flame arrester can operate at and the maximum explosion pressure that can be withstood. As will be appreciated, higher operating pressures will generate much higher explosion pressures and thus the above results show that the flame arrester of the invention $FA_1$ and $FA_2$ are much more capable of withstanding detonations than those not fabricated in accordance with the invention.

Figure 4:
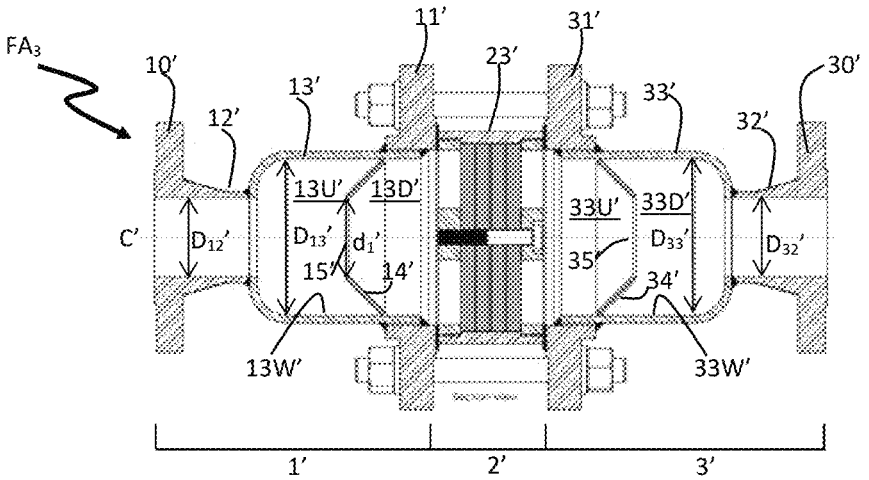
FIG. 4 shows a sectional view of a second embodiment of a flame arrester according to the invention.

Referring to FIG. 4, there is shown a further flame arrester $FA_3$ made in accordance with the invention. As this is similar to the flame arrester $FA_1$ of FIGS. 2A-2D, equivalent integers are indicated by the same numeral but with the addition of a prime (').

Further elucidation of the integers of this flame arrester can be determined from the above description.

In this flame arrester $FA_3$, $D_{13'}$ is equal to $D_{33'}$ and $D_{12'}$ is equal to $D_{32'}$ and $d_{1'}$ is equal to $d_{3'}$, although in each case the first respective integer may be larger or smaller than the second respective integer.

The entrance portion 1' comprises a baffle plate 14' which has a central aperture 15' with a diameter $d_{1'}$. The plane defined by the aperture is parallel to, and is positioned a distance $L_{1'}$ from the leading face of the flame arrester element 20'. The exit portion 3' comprises a baffle plate 34' which has a central aperture 35' with a diameter $d_3$. The plane defined by the aperture 35' is parallel to, and is positioned a distance $L_{3'}$ from, the trailing face of the flame arrester element 20'. As shown $d_{1'}$ is equal to $d_{3'}$ but it need not be, it may be larger or smaller.

In some embodiments $d_{1'} \geq 0.75D_{12'}$, but in a preferred embodiment $d_{1'} \geq 0.8D_{12'}$, preferably $d_{1'} \geq 0.85D_{12'}$, $d_{1'} \geq 0.9D_{12'}$, $d_{1'} \geq 0.95D_{12'}$, $d_{1'} \geq 1.0D_{12'}$, $d_{1'} \geq 1.05D_{12'}$ and most preferably $d_{1'} \geq 1.1D_{12'}$. In a preferred embodiment, the ratio of surface area of baffle aperture $A_{15'}$ to surface area of supply conduit $A_{12'}$ (i.e. $A_{15'}$-$A_{12'}$) is from 0.55 or 0.56 to 4.0, for example from 0.55 or 0.56 to 2.0 or 2.5 and preferably from 0.64 to 1.21.

In a further preferred embodiment for a conduit flame arrester $D_{13'} \geq 1.5$ or $1.6D_{12'}$, preferably $D_{13'} \geq 1.7D_{12'}$, $D_{13'} \geq 1.8D_{12'}$, $D_{13'} \geq 1.9D_{12'}$, $D_{13'} \geq 2.0D_{12'}$, $D_{13'} \geq 2.5D_{12'}$, $D_{13'} \geq 3.0D_{12'}$, and most preferably $D_{13'} > 2.0D_{12'}$.

In some embodiments $L_{1'}$ is from $0.1D_{12'}$ to $2.0D_{12'}$, say $0.2D_{12'}$ to $1.5D_{12'}$ preferably $0.3D_{12'}$ to $1.0D_{12'}$, and in certain embodiments from $0.4D_{12'}$ $0.75D_{12'}$, for example $0.5D_{12'}$ or larger.

In some embodiments $L_3$ is from $0.1D_{32'}$ to $2.0D_{32'}$, say $0.2D_{32'}$ to $1.5D_{32'}$, preferably $0.3D_{32'}$ to $1.0D_{32'}$, and in certain embodiments from $0.4D_{32'}$ to $0.75D_{32'}$, for example $0.5D_{32'}$ or larger.

It is noted that the baffle plate 14' of the entrance portion 1' is tapered, so as to provide a frusto-conical surface with the base of the frusto-cone being downstream of the aperture 15'. Similarly, the baffle plate 34' of the exit portion 3' is tapered, so as to provide a frusto-conical surface with the base of the frusto-cone being upstream of the aperture 35'. Of course the baffle plate 34' of the exit portion 3' may be orthogonal to the principle axis of the flow path C or may be absent altogether. The baffle plate 14' may, alternatively, flare inwardly from the periphery of the housing.

Without wishing to be bound by any particular theory, it is believed that the sloping walls of the baffle plate 14' will further improve the operation of the flame arrester $FA_3$ by improving the flow distribution over the flame arrester element during 'normal use', thereby improving flow capacity of the flame arrester $FA_3$.

Figure 5:
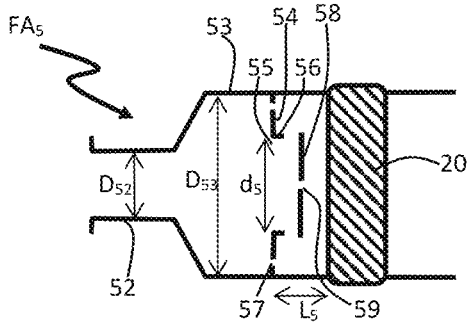
FIG. 5 shows a sectional view of a portion of a third embodiment of a flame arrester according to the invention.

Reference is now made to FIG. 5, which shows, inter alia, an entrance portion and central portion of a further embodiment of flame arrester $FA_5$ according to the invention. The flame arrester $FA_5$ is of similar form to the above-described flame arrester, $FA_2$. As such, only the differences will be described.

The flame arrester $FA_5$ has a lead-in conduit 52 with a diameter $D_{52}$. The lead-in conduit is upstream of, and in fluid communication with, a housing 53 with a diameter $D_{53}$. The housing 53 comprises a baffle plate 54 having a central or main aperture 55 with a size $d_5$. The peripheral edge of the baffle plate 54, bounding the aperture 55 is optionally provided with an extension portion 56 extending towards a flame arrester element 20. The optional extension portion 56 is preferably of insufficient length to cause a propagating detonation front to be directed solely towards the flame arrester element 20. The baffle plate 54 further comprises one or more optional satellite apertures 57 regularly on irregularly distributed around the baffle plate 54. The flame arrester $FA_5$ further comprises an optional flow diverter plate 58, it is optionally provided with one or more flow apertures 59 which may be distributed irregularly or regularly across the diverter plate 58.

The diverter plate 58, if present, may be larger, the same size or smaller than the aperture 55. In some embodiments we prefer the diverter plate to be larger than the aperture 55 so as to maximise the effect of the diverter plate 58. The diverter plate 58 may be located upstream or downstream of the aperture 55, or indeed in alignment with the aperture 55 (in which case the diverter plate 58 will obviously be smaller than the aperture 55).

Figure 5A:
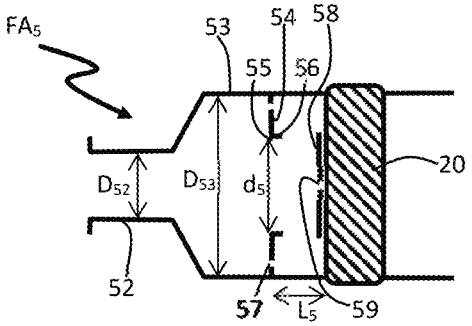
FIG. 5A shows a sectional view of a version of the third embodiment of flame arrester.
Figure 5B:
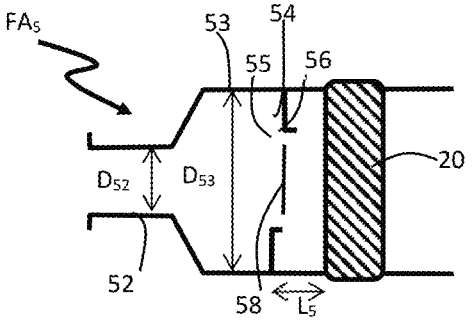
FIG. 5B shows a sectional view of a second version of the third embodiment of flame arrester.
Figure 5C:
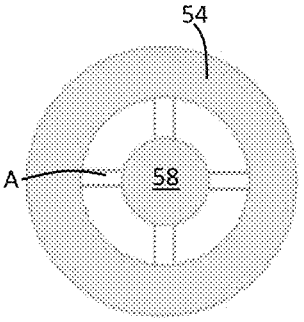
FIG. 5C shows a part of the flame arrester of FIG. 5B.

In one embodiment (see FIG. 5A) the diverter plate 58 is in close proximity to, or indeed in contact with, the flame arrester element 20. In this instance the size of the diverter plate 58 may be larger, the same size or smaller than the aperture 55. In another embodiment (see FIGS. 5B and C), the diverter plate 58 (which may have optional through apertures, not shown) is aligned with the baffle plate 54 (which may have optional satellite apertures, not shown). In this instance the diverter plate 58 may be joined to the baffle plate 54 by arms or other radial supporting structures A.

In this instance the plane defined by the leading edge of the aperture 55, e.g. the primary or main aperture is parallel to, and a distance $L_5$ from, the leading face of the flame arrester element 20.

As before, in some embodiments $d_5 \geq 0.75D_{52}$, but in a preferred embodiment $d_5 \geq 0.8D_{52}$, preferably $d_5 \geq 0.85D_{52}$, $d_5 \geq 0.9D_{52}$, $d_5 \geq 0.95D_{52}$, $d_5 \geq 1.0D_{52}$, or $d_5 \geq 1.05D_{52}$ and most preferably $d_5 \geq 1.1D_{52}$.

In a further preferred embodiment for the flame arrester $D_{53} \geq 1.5D_{52}$ or $D_{53} \geq 1.6D_{52}$, preferably $D_{53} \geq 1.7D_{52}$, $D_{53} \geq 1.8D_{52}$, $D_{53} \geq 1.9D_{52}$, $D_{53} \geq 2.0D_{52}$, $D_{53} \geq 2.5D_{52}$, $D_{53} \geq 3.0D_{52}$, and most preferably $D_{53} > 2.0D_{52}$.

In some embodiments $L_5$ is from $0.1D_{52}$ to $2.0D_{52}$, say $0.2D_{52}$ to $1.5D_{52}$, preferably $0.3D_{52}$ to $1.0D_{52}$, and in certain embodiments from $0.4D_{52}$ to $0.75D_{52}$, for example $0.5D_{52}$ or larger.

Figure 6:
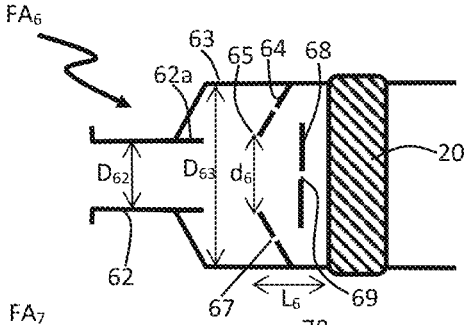
FIG. 6 shows a sectional view of a portion of a fourth embodiment of a flame arrester according to the invention.

Reference is now made to FIG. 6, which shows, inter alia, an entrance portion 6 of a further embodiment of flame arrester $FA_6$ according to the invention. The flame arrester $FA_6$ is of similar form to the above-described flame arresters, $FA_3$ and $FA_5$. As such, only the differences will be described.

The flame arrester $FA_6$ has a lead-in conduit 62 with a diameter $D_{62}$. The lead-in conduit 62 is upstream of, and in fluid communication with, a housing 63 having a diameter $D_{63}$. The housing 63 comprises a baffle plate 64 having a central aperture 65 with a size $d_6$. The peripheral edge of the baffle plate 64, bounding the aperture 65 is optionally provided with an extension portion (not shown) extending towards a flame arrester element 20. The baffle plate 64 further comprises one or more optional satellite apertures 67 regularly or irregularly distributed around the baffle plate 64. The flame arrester $FA_6$ further comprises an optional flow diverter plate 68, it is optionally provided with one or more flow apertures 69 which may be distributed irregularly or regularly across the diverter plate 68.

The diverter plate 68, if present, may be larger, the same size or smaller than the aperture 65. In some embodiments we prefer the diverter plate to be larger than the aperture 65 so as to maximise the effect of the diverter plate 68.

In this instance the plane defined by the leading edge of the aperture 65 is parallel to, and a distance $L_6$ from, the leading face of the flame arrester element 20.

The lead-in conduit 62 may be provided with an optional extension 62*a* (which may also be provided on the flame arresters $FA_2$ of FIG. 5 and $FA_5$ of FIG. 5) which protrudes into the housing 63. The distance which the extension portion 62*a* protrudes may be variable or varied.

The baffle plate 64 is tapered so as to provide a frusto-conical surface with the base of the frusto-cone being downstream of the aperture 65.

As before, in some embodiments $d_6 \geq 0.75D_{62}$, but in a preferred embodiment $d_6 \geq 0.8D_{62}$, preferably $d_6 \geq 0.85D_{62}$, $d_6 \geq 0.9D_{62}$, $d_6 \geq 0.95D_{62}$, $d_6 \geq 1.0D_{62}$, or $d_6 \geq 1.05D_{62}$ and most preferably $d_6 \geq 1.1D_{62}$, in each case the maximum is likely to-be $1.6D_{62}$. However, if the diverter plate 68 is present the aperture 65 may be larger than $1.6D_{62}$, say up to $1.8D_{62}$.

In a further preferred embodiment for a conduit flame arrester $D_{63} \geq 1.5D_{62}$ or $D_{63} \geq 1.6D_{62}$, preferably $D_{63} \geq 1.7D_{62}$, $D_{63} \geq 1.8D_{62}$, $D_{63} \geq 1.9D_{62}$, $D_{63} \geq 2.0D_{62}$, $D_{63} \geq 2.5D_{62}$, $D_{63} \geq 3.0D_{62}$, and most preferably $D_{63} > 2.0D_{62}$.

In some embodiments $L_6$ is from $0.15D_{62}$ to $2.5D_{62}$, say $0.2D_{62}$ to $2.0D_{62}$ or $1.5D_{62}$, preferably $0.3D_{62}$ to $1.0D_{62}$, and in certain embodiments from $0.4D_{62}$ to $0.75D_{62}$, for example $0.5D_{62}$ or $0.7D_{62}$.

Figure 7:
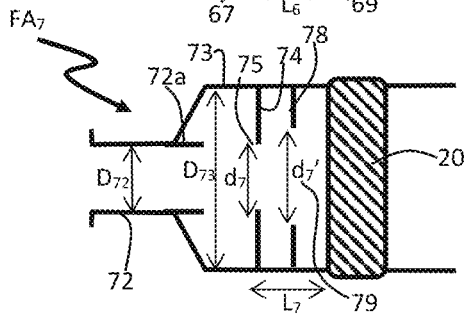
FIG. 7 shows a sectional view of a portion of a fifth embodiment of a flame arrester according to the invention.

Reference is now made to FIG. 7, which shows, inter alia, an entrance portion 7 of a further embodiment of flame arrester $FA_7$ according to the invention. The flame arrester $FA_7$ is of similar form to the above-described flame arrester, $FA_3$. As such, only the differences will be described.

The flame arrester $FA_7$ has a lead-in conduit 72 with a diameter $D_{72}$. The lead-in conduit 72 is upstream of, and in fluid communication with, a housing 73 having a diameter $D_{73}$. The housing 73 comprises a baffle plate 74 having a central aperture 75 with a size $d_7$. The peripheral edge of the baffle plate 74, bounding the aperture 75 is optionally provided with an extension portion (not shown) extending towards a flame arrester element 20. The baffle plate 74 further comprises one or more optional satellite apertures (not shown) regularly or irregularly distributed around the baffle plate 74. The flame arrester $FA_7$ further comprises an secondary baffle plate 78, itself optionally provided with one or more flow apertures (not shown) which may be distributed irregularly or regularly across the secondary baffle plate 78. The secondary baffle plate 78 has a central aperture 79 with a diameter $d_{7'}$ which is preferably larger than $d_7$ (although it may be smaller or the same size).

In this instance the plane defined by the leading edge of the aperture 75 is parallel to, and a distance $L_7$ from, the leading face of the flame arrester element 20. The plane defined by the leading edge of the aperture 79 is parallel to, and a distance $L_{7'}$ from, the leading face of the flame arrester element 20. The baffle plate 74 and secondary baffle plate 78 may each comprise one or more satellite flow apertures (not shown) distributed regularly or irregularly thereabout.

The lead-in conduit 72 may be provided with an optional extension 72*a* which protrudes into the housing 73. The distance which the extension portion 72*a* protrudes may be variable or varied.

As before, in some embodiments $d_7 \geq 0.75D_{72}$, but in a preferred embodiment $d_7 \geq 0.8D_{72}$, preferably $d_7 \geq 0.85D_{72}$, $d_7 \geq 0.9D_{72}$, $d_7 \geq 0.95D_{72}$, $d_7 \geq 1.0D_{72}$, or $d_7 \geq 1.05D_{72}$ and most preferably $d_7 \geq 1.1D_{72}$.

In a further preferred embodiment for a conduit flame arrester $D_{73} \geq 1.5D_{72}$ or $D_{73} \geq 1.6D_{72}$, preferably $D_{73} \geq 1.7D_{72}$, $D_{73} \geq 1.8D_{72}$, $D_{73} \geq 1.9D_{72}$, $D_{73} \geq 2.0D_{72}$, $D_{73} \geq 2.5D_{72}$, $D_{73} \geq 3.0D_{72}$, and most preferably $D_{73} > 2.0D_{72}$.

In some embodiments $L_{7'}$ is from $0.1D_{72}$ to $2.0D_{72}$, say $0.2D_{72}$ to $1.5D_{72}$, preferably $0.3D_{72}$ to $1.0D_{72}$, and in certain embodiments from $0.4D_{72}$ to $0.75D_{72}$, for example $0.5D_{72}$ or larger.

Typically, but not always, $L_7$ will be significantly larger than as set out before in relation to previous embodiments. For example, $L_7$ may be from $0.5D_{72}$ to 2.5 or $3.0D_{72}$.

The distance between baffle plate 74 and secondary baffle plate 78 and/or the distance between baffle plate 74 and the extension portion 72*a* may be variable or may be chosen according to requirement.

Figure 8:
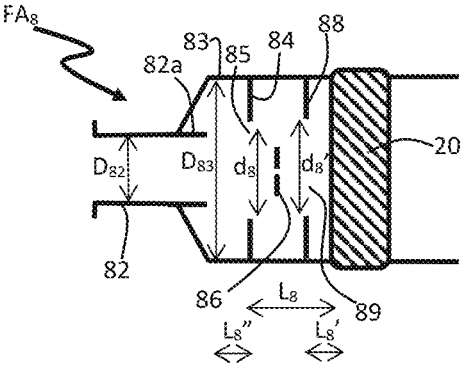
FIG. 8 shows a sectional view of a portion of a sixth embodiment of a flame arrester according to the invention.

Referring now to FIG. 8, which shows, inter alia, an entrance portion 8 of a further embodiment of flame arrester $FA_8$ according to the invention. The flame arrester $FA_8$ is of similar form to the above-described flame arrester, $FA_7$. As such, only the differences will be described.

The flame arrester $FA_8$ has a lead-in conduit 82 with a diameter $D_{82}$. The lead-in conduit 82 is upstream of, and in fluid communication with, a housing 83 having a diameter $D_{83}$. The housing 83 comprises a first baffle plate 84 having a central aperture 85 with a size $d_8$. The peripheral edge of the baffle plate 84, bounding the aperture 85 is optionally provided with an extension portion (not shown) extending towards a flame arrester element 20. The baffle plate 84 further comprises one or more optional satellite apertures (not shown) regularly or irregularly distributed around the baffle plate 84. The flame arrester $FA_8$ further comprises a secondary baffle plate 88, itself optionally provided with one or more satellite apertures (not shown) which may be distributed irregularly or regularly across the secondary baffle plate 88. The secondary baffle plate 88 has a central aperture 89 with a diameter $d_{8'}$ which is preferably the same size as $d_8$ (although it may be smaller or larger).

In this instance the plane defined by the leading edge of the aperture 85 is parallel to, and a distance $L_8$ from, the leading face of the flame arrester element 20. The plane defined by the leading edge of the aperture 89 is parallel to, and a distance $L_{8'}$ from, the leading face of the arrester element 20.

The lead-in conduit 82 may be provided with an optional extension 82*a* which protrudes into the housing 83. The distance which the extension portion 82*a* protrudes may be variable or varied.

There is further provided an optional deflector plate 86 which is optionally provided with one or more satellite apertures which may be regularly or irregularly distributed across the deflector plate 86. For example, there may be a single, central satellite aperture, as shown. The deflector plate 86 is shown as being located downstream of the first baffle plate 84 and upstream of the secondary baffle plate 88. Although we do not intend to be bound by any particular theory, it is believed that such an arrangement generates a maximum amount of tortuous flow and thereby helps to arrest the progress of a flame front. Alternatively, the deflector plate 86 may be downstream of the secondary baffle plates 88 or upstream of both baffle plates 84, 88.

The deflector plate 86, if present, may be larger, the same size or smaller than the aperture 85. In some embodiments we prefer the deflector plate to be smaller than the aperture 85 to reduce pressure drop although if it is the same size or larger than the aperture 85 it may act to maximise the effect of the deflector plate 86.

As before, in some embodiments $d_8 \geq 0.75D_{82}$, but in a preferred embodiment $d_8 \geq 0.8D_{82}$, preferably $d_8 \geq 0.85D_{82}$, $d_8 \geq 0.9D_{82}$, $d_8 \geq 0.95D_{82}$, $d_8 \geq 1.0D_{82}$, or $d_8 \geq 1.05D_{82}$ and most preferably $d_8 \geq 1.1D_{82}$.

In a further preferred embodiment for a flame arrester $D_{83} \geq 1.5D_{82}$ or $D_{83} \geq 1.6D_{82}$, preferably $D_{83} \geq 1.7D_{82}$, $D_{83} \geq 1.8D_{82}$, $D_{83} \geq 1.9D_{82}$, $D_{83} \geq 2.0D_{82}$, $D_{83} \geq 2.5D_{82}$, $D_{83} \geq 3.0D_{82}$, and most preferably $D_{83} > 2.0D_{82}$.

In some embodiments $L_{8'}$ is from $0.1D_{82}$ to $2.0D_{82}$, say $0.2D_{82}$ to $1.5D_{82}$, preferably $0.3D_{82}$ to $1.0D_{82}$, and in certain embodiments from $0.4D_{82}$ to $0.75D_{82}$, for example $0.5D_{82}$ or larger.

Typically $L_8$ will be significantly larger than as set out before in relation to previous embodiments. For example, $L_8$ may be from $0.5D_{82}$ to 2.5 or $3.0D_{82}$.

$L_{8'}$ may be varied according to desired flow characteristics and/or space requirements (e.g. installation size) and/or the dimensions of apertures 85 and 89.

In each of FIGS. 5 to 8 the downstream portion of the respective flame arrester may comprise the same components as the upstream portion shown. Alternatively, the downstream portion may have different components, for example, the exit portion 3 of FIG. 2C may be used in conjunction with the upstream portion of FIG. 6. Alternatively, the exit, portion 3' of FIG. 4 may be used with the upstream portion of FIG. 7 and so on. For reasons of ease of manufacture and installation it may be the case that it is preferred to use a symmetrical arrangement of components but the optimum arrangement will be use specific.

The particular configuration will be chosen according to the flow characteristics under normal conditions and the operating characteristics desired during an explosion event.

Figure 9:
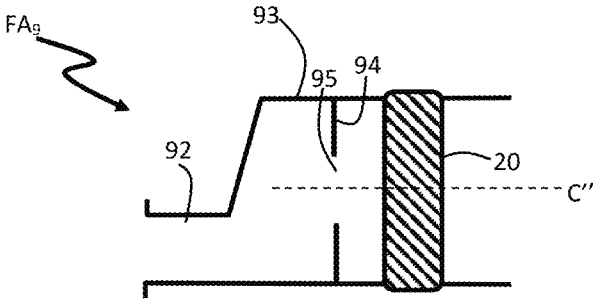
FIG. 9 shows a sectional view of a portion of a seventh embodiment of a flame arrester according to the invention.

FIG. 9 shows a further flame arrester $FA_9$ with an off-axis lead-in conduit 92, we call this an eccentric flame arrester, which may prevent condensate build-up. All other criteria are as per FIG. 3. However, and as shown, the housing 93, baffle plate 94 and flame arrester element 20 are located concentrically about an axis of rotational symmetry (which is parallel to and aligned with a principal flow path C"). However, the aperture 95 in the baffle plate 94 need not be aligned concentrically with the axis of rotational symmetry of the flame arrester and housing, it may be displaced therefrom.

Each of the above flame arresters shown in FIGS. 3 to 8 could be provided as off-axis flame arresters. In each case, the lead-in conduit may be off-axis and the exhaust conduit on axis; or vice versa, or both the lead-in and exhaust conduits may be on axis or both off-axis.

Figure 10:
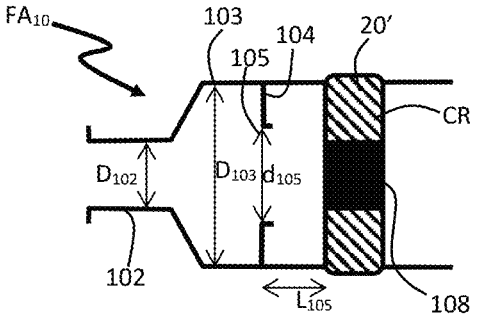
FIG. 10 shows a sectional view of an eighth embodiment of a flame arrester according to the invention.

Referring now to FIG. 10, there is shown a flame arrester $FA_{10}$ which takes the embodiment of FIG. 5 (and specifically FIG. 5A) a further step. This embodiment is identical to FIG. 5 except in relation to the diverter plate 58 and so only the differences will be mentioned here (corresponding features to the embodiment of FIG. 5 are given prefix '10' instead of '5'). In this embodiment of flame arrester $FA_{10}$, the flame arrester element 20' has a central solid core 108. Clearly, the solid core 108 will prevent flow (both in 'normal' use and during a detonation or deflagration event). As such, an impinging wave front will pass through the aperture 105 of the baffle plate 104 whereupon it will spread out slightly, the major portion passing through the aperture 105 to impinge the solid core 108. The solid core 108 will absorb the energy of the impinging wave front (acting as a shock wave absorber or momentum attenuator) and/or will reflect the impinging wave (or at least a major portion of it) back along the housing 103.

The flame arrester element 20' may be conveniently manufactured by winding a crimped ribbon CR (e.g. consisting of or comprising a corrugated layer and a flat layer of metal strip) around a solid mandrel 108. The end of the crimped ribbon CR may be secured to the solid mandrel 108 (e.g. using adhesive, spot welding or otherwise) and then wound around until the required size has been reached for the flame arrester element 20'. The end of the crimped ribbon CR may then be secured (e.g. by adhesive, welding, using a securing band or otherwise) and the flame arrester element 20' will be ready for use. The size of the mandrel (and hence core 108) may be smaller, the same size or larger than the intended size of the aperture 105. The length of the core 108 (i.e. as measured in the direction of flow F) may be longer, the same size or shorter than the remainder of the flame arrester element 20' (i.e. the crimped ribbon CR part). The leading face of the core 108 may protrude in front of the leading face of the crimped ribbon CR of the flame arrester element 20', or may be flush therewith or rebated therefrom).

The mandrel (and hence core 108) may be solid or may be hollow. Although the above mentions crimped ribbon, other types of flame arrester elements may be used.

In each of the flame arresters disclosed above, the distance between the leading face or portion of the baffle plate and the leading face of the flame arrester element in terms of the aperture dimension is preferably between 0.1 to 2.5 times the minimum diametric dimension of the aperture, and is preferably 0.2 to 2.0, preferably 0.3 to 1.5, more preferably 0.4 to 1.0, for example, 0.5 or 0.75 times the minimum diametric dimension of the aperture. That is, for the first embodiment of flame arrester $FA_1$ (and $FA_2$), $L_1$ is from 0.1 to $2.5d_1$.

Each of the flame arresters described above may be used in flues to protect any contents stored in a vessel from a flashback down or along the flue.

It will be usual for the flame arresters to have a circular cross section along their entire length, although this need not be the case. Other shapes are usable but are less preferred from a flow and manufacture point of view.

Moreover, the three part construction shown in FIGS. 2C and 4 is preferred to allow replacement and/or maintenance of the flame arrester element 20, 20'. Of course, other constructions are possible.

Whilst we have not explicitly described the shape of the various apertures it will be appreciated that they will typically be circular. However, other shapes also fall within the scope of the invention, rectangular (including square), triangular, other regular polygons, irregular polygons, further the aperture may have a honeycomb or other partially occluding structure thereover or therein.

Where the baffle plate (e.g. baffle plate 55) comprises satellite apertures (e.g. satellite apertures 57) the total flow through area of the baffle plate (i.e. the total sum of the aperture area, e.g. $A_{55}$ and the sum of the area defined by the satellite apertures) may not exceed 2.5 times the area of the lead-in conduit (e.g. area $A_{52}$ of lead-in conduit 52). We call this the Total Flow-Through Area (TFTA) of the baffle and we have determined that TFTA should be less than 2.5 times but more than 0.5 times the area of the respective inlet conduit.

Each of the flame arresters described above may have one or more further baffle plates downstream of the baffle plate but upstream of the flame arrester element. In each case, one of more diverter or deflector plates may be deployed.

The baffle plates are shown as flat, featureless plates and they may be constructed as such. Alternatively, the baffle plate, secondary baffle plate or deflector plate may be shaped. For example, the portion of each baffle plate which is to be attached to the inner wall of the housing may be wider or thicker than the portion bounding the aperture. This may help during the fabrication process and/or may further help the plate to withstand impinging direct and reflected shock waves.

It should also be noted that where the baffle plate is shown as being orthogonal to the principal flow path, for example in FIG. 2C (where the baffle plate 14 extends transversely across the housing 13 orthogonally to the flow direction C), the baffle plate may also be provided at an inclined angle to the principal flow path. Whilst the angle may be up to 45°, it will be usual for the angle to be more shallow, for example from 5 to 30°. Similarly, secondary baffle plates and diverter plates (if present) may be angled to the principal flow path. The angles of the or each of the baffle plate, secondary baffle plate and diverter plate (as appropriate) will be chosen for particular requirements and applications.

Figure 11:
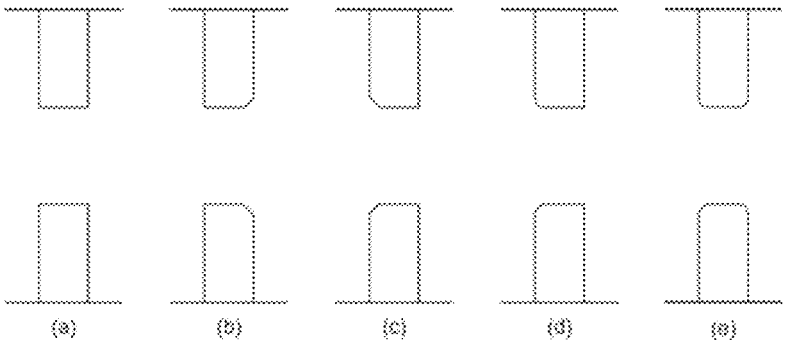
FIG. 11 shows sectional views of various baffle plate profiles.

Referring to FIG. 11, there is illustrated schematically in cross sectional view, different perimeter portions of the baffle plate incorporating apertures. The shape of the baffle plate at the perimeter of the aperture can be varied with various levels or chamfers or rounding; either on one side or both sides of the baffle plate. The variations shown in FIG. 11 are applicable to each of the embodiments described hereinabove. The perimeter of the aperture where the aperture passes from one side of the baffle plate to another, is generally cylindrical, but the portions of the baffle plate immediately adjacent the main surfaces of said baffle plate may be curved or chamfered to allow better gas flow and/or reduce turbulence and/or reduce pressure loss of the flame arrester during normal operation.

In FIG. 11*a* there is shown a 90° edge on both sides of the baffle plate surrounding an aperture.

In FIG. 11*b* there is shown a perimeter of an aperture having one squared off 90° edge, and another edge which has been chamfered at 45°, connecting an inner cylindrical surface, and an outer flat planar surface of the baffle plate.

In FIG. 11*c* there is shown an aperture having a 45° chamfered perimeter edge in a direction upstream of the gas flow, and a 90° edge in a direction downstream of the gas flow direction.

In FIG. 11*d* there is shown an aperture in a baffle plate, in which a circular perimeter of the aperture on the side of the baffle plate upstream of the gas flow is rounded off, and a second perimeter of the aperture on the side of the baffle plate downstream of the gas flow has a 90° edge.

In FIG. 11*e* there is shown a further aperture perimeter shape in which a perimeter of the aperture on the side of the baffle plate upstream of the gas flow has a rounded circular edge, and similarly; a perimeter of the aperture on a downstream side of the baffle plate is also similarly rounded with a rounded circular edge.

Figure 12A:
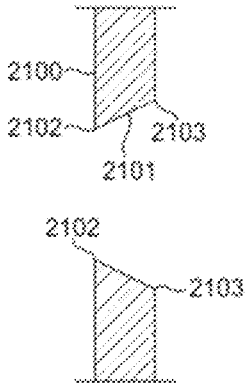
FIG. 12A to 12C show alternative sectional views of various baffle plate profiles.

Referring to FIG. 12A, there is shown in cross sectional view a further example of a perimeter profile of a baffle plate 2100, showing the edges of the baffle plate 2100 around an aperture. The baffle plate 2100 has a frusto-conical surface 2101 which extends around a perimeter of an aperture in the baffle plate 2100, where in this case a smaller dimension across the aperture is presented on the face of the baffle plate 2100 which is upstream of the gas flow, on the side of the first compartment, and there is a frusto-conical surface through the width of the baffle-plate 2100 extending along a main length axis of the housing, there being a relatively wider dimension edge on the side of the second compartment. Adjacent the first compartment, an edge 2102 of the baffle plate 2100 forms an angle of less than 90°, and adjacent the second compartment, an edge 2103 of the baffle plate 2100 has an angle of greater than 90°, as shown in cross sectional view. The sides of the aperture across the width of the baffle plate 2100 therefore diverge in the direction of gas flow.

Figure 12B:
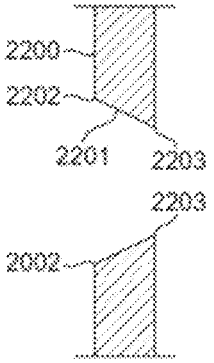

Referring to FIG. 12B, there is shown in cross sectional view yet another example of a perimeter profile of a baffle plate 2200, showing the edges of the baffle plate 2200 around an aperture. In this case, a frusto-conical surface 2201 has its wider portion facing the first compartment, upstream of the gas flow, and has its narrower portion adjacent the second compartment, downstream of the gas flow. Adjacent the first compartment an edge 2202 of the baffle plate 2200 has an angle of greater than 90°, whilst adjacent the second compartment an edge 2203 of the baffle plate 2200 has an angle of less than 90°, as shown in cross sectional view. The sides of the aperture, therefore, converge in the direction of the gas flow.

Figure 12C:
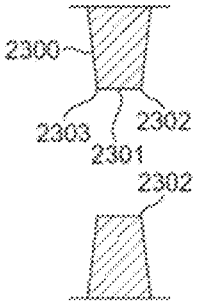

Referring to FIG. 12C, there is shown in cross sectional view a further example of a perimeter profile of a baffle plate 2300, showing the edges of the baffle plate 2300 around an aperture. In this example the baffle plate 2300 is concave on the side facing the first compartment, and concave on the side facing the second compartment, so that the thickness of the baffle plate 2300 around the perimeter of the aperture is less than the thickness of the baffle plate 2300 nearer the internal walls of the housing. In other words, the baffle plate 2300 becomes relatively thinner towards the centre of the housing. Where the aperture passes through the baffle plate 2300 there is a substantially cylindrical surface 2301 defining the aperture. In the embodiment shown in FIG. 12C the baffle plate 2300 becomes gradually thicker in a radial direction extending outwardly from the centre of the aperture.

The baffle plate and/or secondary baffle plate, and/or diverter plate may be solid (i.e. such that one or more or each may completely inhibit fluid flow therethrough) or may be microporous (i.e. may have micropores to allow microporous fluid flows) or may be macroporous (i.e. may have micropores to allow macroporous fluid flows). An example may be where a diverter plate is formed from a sintered material which is below, e.g. well below, its theoretical density and has an open porous structure to permit at least some fluid flow therethrough.

Figure 13:
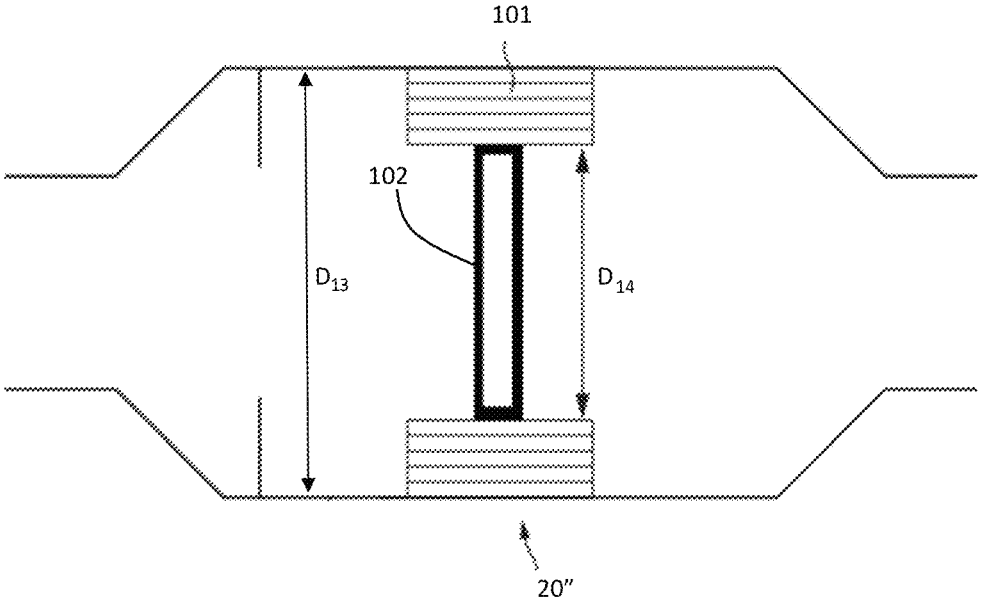
FIG. 13 shows a sectional view of an alternate embodiment of a flame arrester according to the invention.

Referring to FIG. 13, there is shown a flame arrester element 20" having a peripheral portion 101 which may be composed of e.g. crimped ribbon and a central section 102 which may be solid or may be hollow with solid faces and edges. The central section 102 may be of greater, lesser or similar thickness, in the direction of flow, as the peripheral portion 101. The central section 102 may be rebated, in-line or projecting relative to the leading face and/or trailing face of the peripheral portion 101. The central section 102 may have a transverse diameter $D_{14}$ which may have a relation to the internal diameter $D_{13}$, such that $D_{14} \leq 0.75D_{13}$, $D_{14} \leq 0.65D_{13}$, $D_{14} \leq 0.55D_{13}$, $D_{14} \leq 0.45D_{13}$, $D_{14} \leq 0.35D_{13}$, $D_{14} \leq 0.25D_{13}$, $D_{14} \leq 0.15D_{13}$, e.g. $D_{14} \leq 0.05D_{13}$.

The flame arresters described herein are useful as detonation flame arresters. However, in certain circumstances they may be deployed as deflagration flame arresters. They are also useful as deflagration flame arresters, in particular to stop strong deflagration (high velocity and pressure flame fronts) or high pressure deflagration.

It will be appreciated that each of the components of the various embodiments of flame arresters according to the invention will be optimised for particular fluid flow characteristics and for each material, e.g. gas, which is to be conveyed therethrough; as well as for the particular type of explosion risk to be mitigated. Indeed, each of the components of various embodiments may be deployed on one or more other embodiment without detracting from the invention which is as set out in the appended Claims, and/or as set out in the above specification.

The invention claimed is:

1. A flame arrester comprising an inlet and an outlet, a housing between the inlet and outlet and a baffle plate and a flame arrester element located within the housing, the inlet and the outlet being on the same axis, wherein the baffle plate is attached to an internal wall of the housing and is spaced from and located between the inlet and the flame arrester element, the baffle plate comprising an aperture and where at least a portion of the baffle plate flares radially outwardly from the aperture and from an axis formed along a flow direction, in a direction from the inlet towards the flame arrester element, the aperture permitting the passage of fluid therethrough.

2. A flame arrester according to claim 1, further comprising a second baffle plate having an aperture, wherein the second baffle plate flares radially inwardly in the direction to that aperture and from an axis formed along a flow direction of that aperture.

3. A flame arrester according to claim 2, wherein the first and/or second baffle plate is frusto-conical.

4. A flame arrester according to claim 1, wherein the inlet for gas to enter the housing has a maximum diametric dimension D, and the aperture has a minimum diametric dimension of at least 0.75D.

5. A flame arrester according to claim 4, wherein the minimum diametric dimension of the aperture is 0.8D or more.

6. A flame arrester according to claim 4, wherein the maximum diametric dimension of the aperture is less than 2D.

7. A flame arrester according to claim 4, wherein the aperture defines a plane, wherein the plane is parallel to or inclined to a leading face of the flame arrester element.

8. A flame arrester according to claim 4, wherein a mid-point of the plane defined by the aperture is a distance from the leading face of the flame arrester element of 0.1D to 2.0D.

9. A flame arrester according to claim 5, wherein the minimum diametric dimension of the aperture is selected from the group consisting of ≥0.85D, ≥0.9D, ≥0.95D, ≥1.0D, ≥1.05D, and ≥1.1D.

10. A flame arrester comprising an inlet and an outlet, a housing between the inlet and outlet and a baffle plate and a flame arrester element located within the housing, the inlet and the outlet being on the same axis, wherein the baffle plate is attached to the internal wall of the housing and is spaced from and located upstream of the flame arrester element, the baffle plate comprising an aperture and where at least a portion of the baffle plate flares inwardly or outwardly in the flow direction to or from the aperture, the aperture permitting the passage of fluid therethrough, wherein the inlet for gas to enter the housing has a maximum diametric dimension D, and the aperture has a minimum diametric dimension of at least 0.75D, wherein the maximum diametric dimension of the aperture is less than 2D and wherein the maximum diametric dimension of the aperture is selected from the group consisting of 1.9D, 1.8D, 1.7D, and 1.6D.

11. A flame arrester comprising an inlet and an outlet, a housing between the inlet and outlet and a baffle plate and a flame arrester element located within the housing, the inlet and the outlet being on the same axis, wherein the housing has a larger cross-sectional area than the inlet and outlet, the baffle plate is attached to the internal wall of the housing and is spaced from and located upstream of the flame arrester element, the baffle plate comprising an aperture and where at least a portion of the baffle plate flares radially inwardly or radially outwardly in the flow direction from or to the aperture and to or from an axis formed along the flow direction, the aperture permitting the passage of fluid through the baffle plate.

12. The flame arrester according to claim 1, wherein the baffle plate extends from the housing.

13. The flame arrester according to claim 2, wherein the second baffle plate is located between the flame arrester element and the outlet.

14. The flame arrester according to claim 11, wherein the baffle plate extends from the housing.

15. A flame arrester according to claim 1, further comprising a second baffle plate having an aperture, wherein the second baffle plate is flat.

* * * * *